US008439006B2

(12) United States Patent
Laubender

(10) Patent No.: US 8,439,006 B2
(45) Date of Patent: May 14, 2013

(54) STARTER DEVICE FOR STARTING INTERNAL COMBUSTION ENGINES

(75) Inventor: Jochen Laubender, Markgrollingeu (DE)

(73) Assignee: Robert Bosch GmbH, Stuttgart (DE)

( * ) Notice: Subject to any disclaimer, the term of this patent is extended or adjusted under 35 U.S.C. 154(b) by 678 days.

(21) Appl. No.: 12/089,220

(22) PCT Filed: Oct. 6, 2006

(86) PCT No.: PCT/EP2006/067133

§ 371 (c)(1),
(2), (4) Date: Feb. 9, 2011

(87) PCT Pub. No.: WO2007/039643

PCT Pub. Date: Apr. 12, 2007

(65) Prior Publication Data

US 2011/0120406 A1 May 26, 2011

(30) Foreign Application Priority Data

Oct. 6, 2005 (DE) ..... 10 2005 048 598

(51) Int. Cl.
*F02N 15/06* (2006.01)
*F02N 11/08* (2006.01)

(52) U.S. Cl.
USPC ..... 123/179.4

(58) Field of Classification Search ..... 123/179.3, 123/179.4, 185.1
See application file for complete search history.

(56) References Cited

U.S. PATENT DOCUMENTS

| | | | | |
|---|---|---|---|---|
| 2,318,232 | A | 5/1943 | Kearney | |
| 4,305,002 | A * | 12/1981 | Mortensen | 290/38 R |
| 4,395,923 | A * | 8/1983 | Giometti | 74/7 R |
| 4,551,630 | A * | 11/1985 | Stahura et al. | 290/38 R |
| 4,774,915 | A * | 10/1988 | Nguyen et al. | 123/179.3 |
| 5,402,758 | A * | 4/1995 | Land et al. | 123/179.3 |
| 5,622,148 | A * | 4/1997 | Xue et al. | 123/179.25 |
| 5,731,638 | A * | 3/1998 | Niimi | 290/38 R |
| 6,651,603 | B2 * | 11/2003 | Osada et al. | 123/179.3 |
| 6,789,520 | B2 * | 9/2004 | Saito | 123/179.3 |
| 7,690,344 | B2 * | 4/2010 | Ma et al. | 123/179.3 |
| 7,784,441 | B2 * | 8/2010 | Ma et al. | 123/179.3 |
| 8,036,815 | B2 * | 10/2011 | Okumoto et al. | 701/110 |
| 2003/0067172 | A1 * | 4/2003 | Niimi | 290/38 R |

FOREIGN PATENT DOCUMENTS

| | | |
|---|---|---|
| DE | 199 11 161 | 9/2000 |
| DE | 100 05 005 | 10/2000 |
| EP | 0 911 516 | 4/1999 |

(Continued)

*Primary Examiner* — Stephen K Cronin
*Assistant Examiner* — Arnold Castro
(74) *Attorney, Agent, or Firm* — Michael J. Striker

(57) ABSTRACT

The invention relates to a starter device which is used to start internal combustion engines, which comprises an electromagnetic toe-in mechanism (10) and a start-stop-mechanism, which in a stop-phase of the internal combustion engine, even during and/or after stopping the internal combustion engine, a positioned state of the toe-in mechanism (10) is provoked, such that when the internal combustion engine is subsequently started, it is already in the positioned state. According to the invention, a locking device (20), which is used to lock the toe-in mechanism (10) in the positioned state, is embodied in such a manner that it can be controlled such that the electromagnetic toe-in mechanism (10) is maintained in the advanced position during the stop-phase.

12 Claims, 2 Drawing Sheets

FOREIGN PATENT DOCUMENTS

Figure 1:
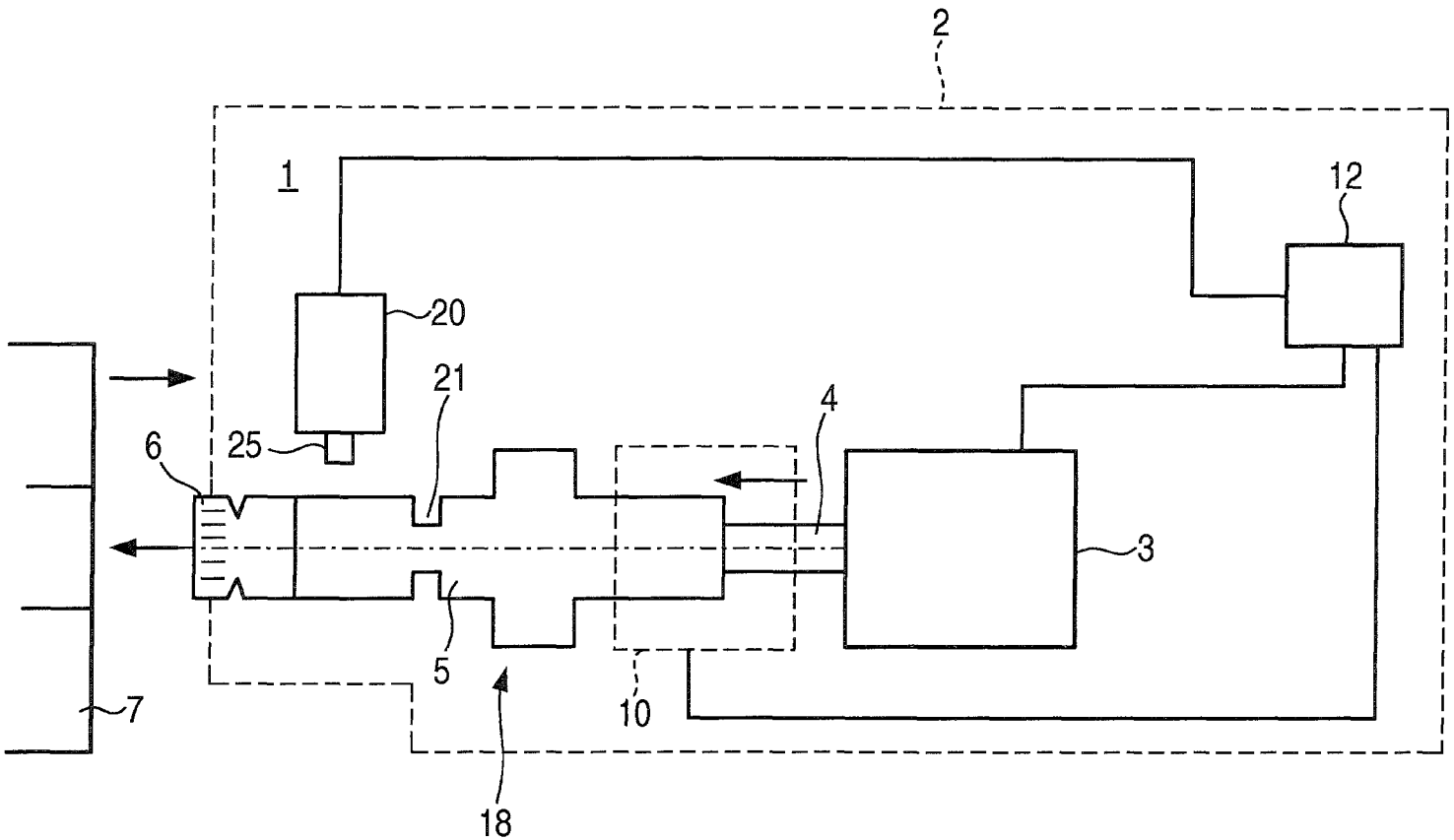

| | | |
|---|---|---|
| GB | 566399 | 12/1944 |
| JP | 2002221133 | 8/2002 |
| WO | 02/35088 | 5/2002 |
| WO | 2006/018350 | 2/2006 |

* cited by examiner

STARTER DEVICE FOR STARTING INTERNAL COMBUSTION ENGINES

The invention relates to a starter device for starting internal combustion engines, with the defining characteristics mentioned in the preamble to claim 1.

PRIOR ART

DE 199 11 161 C2 has demonstrated and described a starter device that is for starting internal combustion engines and is embodied in the form of a coaxial starter. This includes an electric starter motor and a pre-engagement mechanism for moving an axial pinion shaft equipped with a starter pinion. In order to start the engine, the pinion must engage in a ring gear of the engine. Once the engine is running, the pinion must disengage again from the ring gear. To make this possible, the pre-engagement mechanism is provided with a permanent magnet and an electromagnetically excitable coil. An electric control unit enables two flow directions in the coil, which exerts a pushing or pulling force on the permanent magnet, depending on the flow direction. As a result, the pinion can be extended and retracted and therefore engaged and disengaged.

In addition, starter devices of the generic type mentioned at the beginning are known, which permit a so-called start/stop operation. This is distinguished by the fact that an immediate starting of the internal combustion engine is possible. When the engine is switched off, the pinion is already situated in the ring gear so that all that is needed to start the engine is a rotating motion of the pinion. A prerequisite for this is that in a stop phase of the engine, an electromagnetic pre-engagement mechanism holds the pinion in the engaged position. This requires an electrical output that puts a strain on the electrical system and results in a power loss that is accompanied by undesirable heating.

ADVANTAGES OF THE INVENTION

The starter device according to the invention eliminates or reduces the power loss in that the pre-engagement mechanism is locked in the extended position by means of the locking device according to the invention, which locks in a purely mechanical fashion. The invention makes use of the advantages of a start/stop operation without having to accept the disadvantage of a high power consumption. The invention permits a reduced-noise starting of the internal combustion engine and increases the starting convenience with a small amount of electrical energy. It also prevents an excessive heating of circuits and components contained therein such as coils, solenoid switches, relays, resistors and the like. The load on the electrical system and electrical lines is also reduced. Preferably, the start/stop mechanism is embodied so that it produces an engaged state while the engine is still in the process of switching off. This permits a restarting within a time span of less than one second.

In an advantageous modification of the starter device according to the invention, the locking device mechanically holds the electromagnetic pre-engagement mechanism in the engaged state during the stop phase with a small amount of current or even without any current.

A preferred embodiment is characterized in that the locking device is embodied in an electromagnetic form. Preferably, a surge relay is used for the mechanical locking. No power consumption is required to hold the locking device in the locked position. The starter device and/or the pre-engagement mechanism can function electromagnetically, hydraulically, and/or pneumatically.

Another preferred embodiment is characterized in that the locking device is embodied in a thermoelectric form; the locking device includes in particular a locking relay with a thermal circuit. The thermoelectric embodiment is very functionally reliable and works without malfunctioning, even in the event of considerable vibrations, for example due to undulations in a road surface.

The thermoelectric locking relay is suitably provided with at least one bimetallic strip that can be actuated by a heating current. In particular, the bimetallic strip assumes a locked position in a heated state and assumes an unlocked position in a cooled state. This embodiment requires a heating current of approximately 0.5-0.7 A and consequently as little as 1/10 of the power of known embodiments.

Other advantages of the invention ensue from the claims.

DRAWINGS

The invention will be explained in greater detail below in conjunction with two exemplary embodiments shown in the accompanying drawings.

Figure 2:
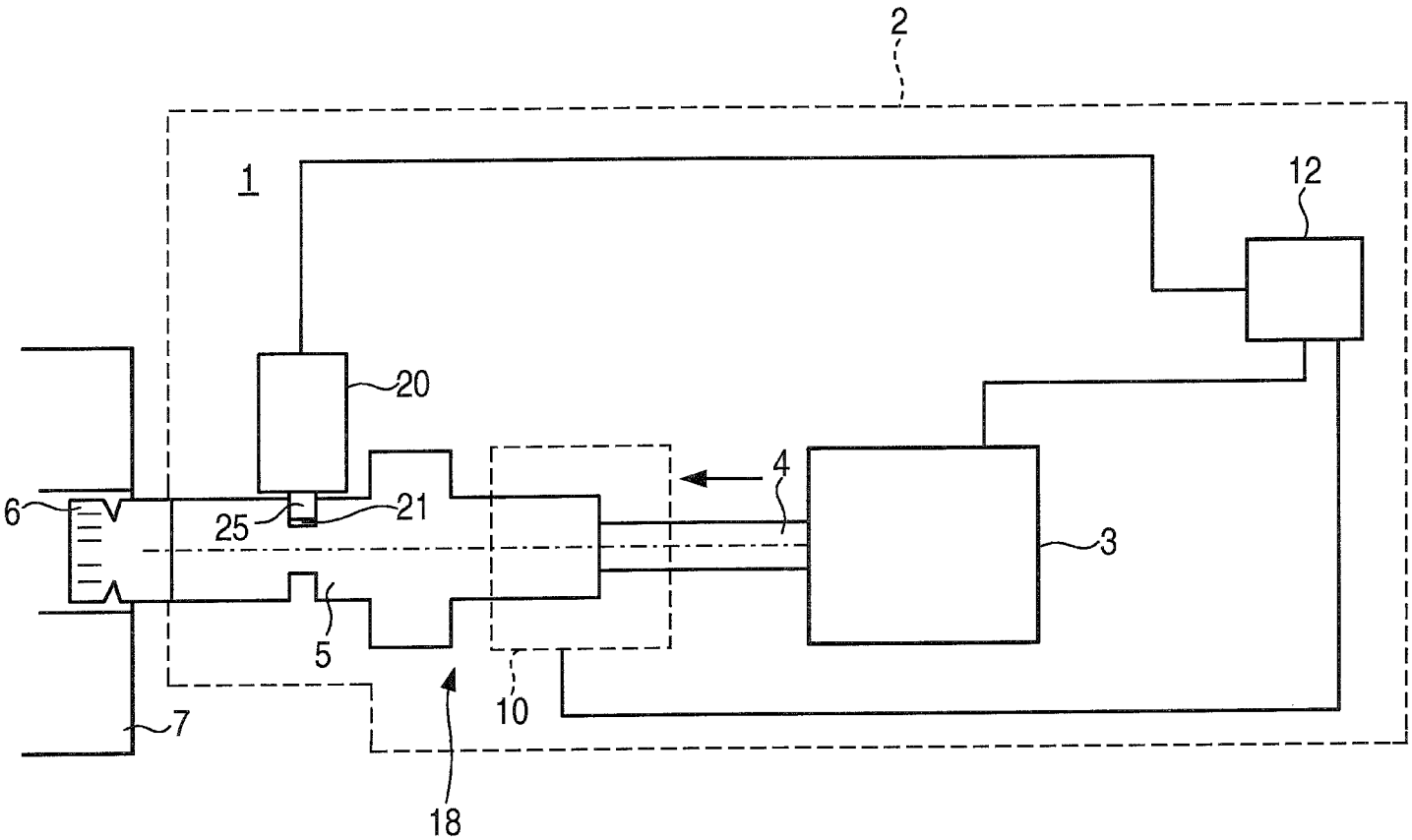

FIG. 1 is a schematic depiction of an embodiment of a starter device according to the invention in a disengaged and unlocked state and FIG. 2 is a schematic depiction of the starter device according to FIG. 1 in an engaged and locked position.

FIG. 1 is a schematic depiction of one embodiment of a starter device 1 according to the invention. It includes a housing 2 with an electromotive drive unit contained therein, which has a starter motor 3 equipped with a drive shaft 4. Situated coaxially around the drive shaft 4, there is a sliding pinion shaft 5 that is provided with a starter pinion 6 for coupling with a ring gear 7 of an internal combustion engine.

The starter pinion 6 can be brought into an extended position with the aid of a pre-engagement mechanism 10 so that the starter pinion 6 engages in the ring gear 7, as shown in FIG. 2 (engaged state), or can be brought into a disengaged state, as shown in FIG. 1, so that the starter pinion 6 assumes a disengaged position.

The pre-engagement mechanism 10 includes an armature with a switchable coil for exerting a force on the pinion shaft 5. This force is able to extend and retract the pinion shaft 5; the force changes directions through a reversed current supply to the coil. To trigger the coil and the starter motor 3, a control unit 12 is provided, which also triggers a mechanically acting locking device 20 according to the invention. Alternatively, it is possible for the pre-engagement mechanism to be situated laterally next to the pinion shaft 5 and to have, for example, an engaging relay whose movement is transmitted to the pinion shaft 5 via a double rocker arm, thus allowing the pinion shaft 5 to be extended and retracted.

According to the invention, the locking device 24 serves to lock the pinion shaft 5 and the pre-engagement mechanism 10 in the engaged position; the locking device 20 is embodied as controllable so that it holds and locks the electromagnetic pre-engagement mechanism 20 and the pinion shaft 5 in the extended position.

The locking device 20 has a movable locking pin 25 that is preferably electromagnetically or electrothermally movable. The locking pin 25 can plunge into a locking socket 21 or into a recess, annular groove, or the like of the pinion shaft 5 in order to produce the locking action. In the locked position, the locking device 20 can function by means of a locking current. This current, however, is a great deal less powerful than an actuating current of the pre-engagement mechanism 10. Preferably, however, the locking device 20 is embodied so that a locked position is achieved without current. Only a brief electrical surge is required to move the locking pin into the locked position and to move it into the unlocked position. Alternatively, the locking device 20 is embodied in a thermoelectric fashion and has a locking relay with an electrical thermal circuit. The locking relay includes a bimetallic strip that can be actuated with a heating current. The heating current, in particular of approximately 0.5-0.7 A, flows through a heating coil that is associated with the bimetallic strip. The heat causes the bimetallic strip to bend and to move a locking means that directly or indirectly engages in the locking socket 21 of the pinion shaft, as depicted in FIG. 2.

The bimetallic strip consequently assumes a locked position (FIG. 2) in the heated state and assumes an unlocked position (FIG. 1) in the cooled state. The heating current is a great deal less powerful than the electrical current required to cause the pre-engagement mechanism to engage.

The starter device 1 is distinguished by a start/stop mechanism that is implemented with the aid of the control unit 12 and that is embodied so that in a stop phase of the internal combustion engine, during and/or after a switching off of the engine, this mechanism produces an engaged state (FIG. 2) of the pre-engagement mechanism 10 so that in a subsequent starting of the engine, the starter pinion 6 is already situated in an extended position.

The pre-engagement mechanism 10 can be moved from the engaged state into the disengaged state through a reversed supply of power to its armature. The disengagement occurs after a successful starting of the internal combustion engine.

The control unit 12 controls the electromotive drive unit, the electromagnetic pre-engagement mechanism 10, and the locking device 20 so that the start/stop operation can be executed.

The invention permits the execution of an immediate, gentle starting. In the stop operation, the locking relay or another locking device, e.g. an electro-magnetic device, is activated by means of a brief flow of current for the locking so that after the circuit for the pre-engagement mechanism 10 is switched off, the drive shaft or the pinion shaft 5 is immobilized in a purely mechanical fashion. The disengagement of the starter device 1 occurs electromagnetically after a successful starting of the internal combustion engine; at the same time, the locking action is canceled by a renewed supply of power to the locking relay in order to disengage it.

The mechanical force of the locking mechanism of the locking relay used must be selected to be powerful enough to cause the pinion 6 of the starter device 1 to remain securely in the engaged position even in the event of possible vibrations of the vehicle, e.g. due to undulations in the road surface during start/stop operation. The disengagement of the pinion 6 can also be executed by means of a free wheel mechanism of the starter device 1.

In the electromagnetic embodiment, preferably a locking relay is used, which can be moved into and out of the locked position by means of a brief current pulse. Consequently, no current flow is required in the locked state.

In a locking relay with a thermal circuit, the mechanical locking is implemented by means of the bimetallic strip that is deformed in the presence of a small amount of heating energy. After the heating current is switched off, the bimetallic strip cools down and returns to its original shape. This cancels the locking.

What is claimed is:

1. A starter device for starting internal combustion engines, comprising:

an in particular electromagnetic pre-engagement mechanism (10), a start/stop mechanism that produces an engaged state of the pre-engagement mechanism (10) in a stop phase of the internal combustion engine, during and/or after a switching off of the engine, so that in a subsequent starting of the engine, the engaged state is already present, and a locking device (20) for locking the pre-engagement mechanism (10) in the engaged state;

wherein the locking device (20) is controllable so that during the stop phase, it mechanically holds the electromagnetic pre-engagement mechanism (10) in the extended position; and wherein the locking device (20) has a locking relay that actuatable by application of current pulses.

2. The starter device as recited in claim 1, wherein during the stop phase, the locking device (20) mechanically holds the electromagnetic pre-engagement mechanism (10) in the engaged state.

3. The starter device as recited in claim 1, wherein the locking device (20) is electromagnetically actuatable.

4. The starter device as recited in claim 1, wherein the mechanical holding or mechanical locking occurs by means of frictional engagement and/or form-locked engagement.

5. A starter device for starting internal combustion engines, comprising:

an in particular electromagnetic pre-engagement mechanism (10), a start/stop mechanism that produces an engaged state of the pre-engagement mechanism (10) in a stop phase of the internal combustion engine, during and/or after a switching off of the engine, so that in a subsequent starting of the engine, the engaged state is already present, and a locking device (20) for locking the pre-engagement mechanism (10) in the engaged state, wherein the locking device (20) is controllable so that during the stop phase, it mechanically holds the electromagnetic pre-engagement mechanism (10) in the extended position, and wherein the locking device (20) is thermoelectrically actuatable.

6. The starter device as recited in claim 5, wherein the mechanical holding or mechanical locking occurs by means of frictional engagement and/or form-locked engagement.

7. A starter device for starting internal combustion engines, comprising:

an in particular electromagnetic pre-engagement mechanism (10), a start/stop mechanism that produces an engaged state of the pre-engagement mechanism (10) in a stop phase of the internal combustion engine, during and/or after a switching off of the engine, so that in a subsequent starting of the engine, the engaged state is already present, and a locking device (20) for locking the pre-engagement mechanism (10) in the engaged state, wherein the locking device (20) is controllable so that during the stop phase, it mechanically holds the electromagnetic pre-engagement mechanism (10) in the extended position, and wherein the locking device (20) has a locking relay with an electrical thermal circuit.

8. The starter device as recited in claim 7, wherein the locking relay includes at least one bimetallic strip that is actuatable by means of a heating current.

9. The starter device as recited in claim 8, wherein the bimetallic strip assumes a mechanical locked position in a heated state and assumes a mechanical unlocked position in a cooled state.

10. The starter device as recited in claim 9, wherein the mechanical holding or mechanical locking occurs by means of frictional engagement and/or form-locked engagement.

11. The starter device as recited in claim 8, wherein the mechanical holding or mechanical locking occurs by means of frictional engagement and/or form-locked engagement.

12. The starter device as recited in claim 7, wherein the mechanical holding or mechanical locking occurs by means of frictional engagement and/or form-locked engagement.

* * * * *